US007183998B2

(12) United States Patent
Wilhelm et al.

(10) Patent No.: US 7,183,998 B2
(45) Date of Patent: Feb. 27, 2007

(54) MICRO-HELIX ANTENNA AND METHODS FOR MAKING SAME

(75) Inventors: Michael J. Wilhelm, Stillwater, OK (US); Robert M. Taylor, Perkins, OK (US); Ryan T. Salisbury, Stillwater, OK (US)

(73) Assignee: Sciperio, Inc., Oklahoma City, OK (US)

( * ) Notice: Subject to any disclaimer, the term of this patent is extended or adjusted under 35 U.S.C. 154(b) by 0 days.

(21) Appl. No.: 10/908,936

(22) Filed: Jun. 1, 2005

(65) Prior Publication Data

US 2005/0270248 A1 Dec. 8, 2005

Related U.S. Application Data

(60) Provisional application No. 60/576,378, filed on Jun. 2, 2004.

(51) Int. Cl.
*H01Q 1/36* (2006.01)

(52) U.S. Cl. ..... 343/895

(58) Field of Classification Search ..... 343/895, 343/788, 702, 787

See application file for complete search history.

(56) References Cited

U.S. PATENT DOCUMENTS

| | | | | |
|---|---|---|---|---|
| 3,956,751 A | | 5/1976 | Herman | |
| 4,014,028 A | * | 3/1977 | Cone et al. | 343/895 |
| 4,068,238 A | * | 1/1978 | Acker | 343/895 |
| 4,109,224 A | * | 8/1978 | Liautaud | 336/192 |
| 4,270,128 A | * | 5/1981 | Drewett | 343/702 |
| 4,489,330 A | | 12/1984 | Marutake et al. | |
| 5,111,164 A | | 5/1992 | De Ronde | |
| 5,211,129 A | | 5/1993 | Taylor et al. | |
| 5,509,929 A | | 4/1996 | Hascoet et al. | |
| 5,608,417 A | | 3/1997 | de Vall | |
| 5,625,366 A | * | 4/1997 | D'Hont | 343/718 |
| 5,668,559 A | * | 9/1997 | Baro | 343/702 |
| 5,777,587 A | | 7/1998 | Tsuru et al. | |
| 5,903,242 A | | 5/1999 | Tsuru et al. | |
| 5,955,996 A | | 9/1999 | Clubb | |

(Continued)

FOREIGN PATENT DOCUMENTS

CS 0248648 B1 2/1987

(Continued)

OTHER PUBLICATIONS

Abstract of patent JP09298417, Nov. 13, 1977.

(Continued)

*Primary Examiner*—Hoang V. Nguyen
(74) *Attorney, Agent, or Firm*—Mary M. Lee

(57) ABSTRACT

A micro-helix antenna. The antenna comprises a helically-shaped conductive element disposed on a dielectric core. The diameter of the helix formed by the conductive element is very small relative to the wavelength of the antenna, preferably no more than about 1/100th of the wavelength. Having such a small diameter, this micro-helix antenna can be further compressed into two- and three-dimensional shapes, such as spirals, helices and meandering or stochastic patterns. The micro-helix antenna can be created by pressing a fine wire into a helical shape. Alternately, the helical conductor can be formed by a laser ablation process or laying down the helical shape using a direct-write process.

55 Claims, 6 Drawing Sheets

U.S. PATENT DOCUMENTS

| | | | | |
|---|---|---|---|---|
| 5,977,927 | A | 11/1999 | Mandai et al. | |
| 5,990,848 | A | 11/1999 | Annamaa et al. | |
| 6,034,650 | A | 3/2000 | Kuramoto | |
| 6,172,655 | B1 | 1/2001 | Volman | |
| 6,179,988 | B1 | 1/2001 | Peckham et al. | |
| 6,271,802 | B1 | 8/2001 | Clark et al. | |
| 6,362,790 | B1 | 3/2002 | Proctor, Jr. et al. | |
| 6,501,438 | B2 | 12/2002 | Nevermann et al. | |
| 6,529,139 | B1 * | 3/2003 | Behun et al. | 340/825.69 |
| 6,602,207 | B1 * | 8/2003 | Mam et al. | 600/585 |
| 6,608,605 | B2 | 8/2003 | Lee et al. | |
| 6,667,092 | B1 * | 12/2003 | Brollier et al. | 428/182 |
| 6,667,725 | B1 | 12/2003 | Simons et al. | |
| 6,693,601 | B2 | 2/2004 | Billiet et al. | |
| 6,822,620 | B2 * | 11/2004 | Watada et al. | 343/895 |
| 6,922,178 | B2 * | 7/2005 | Sutter et al. | 343/895 |
| 6,934,222 | B2 * | 8/2005 | Fujimori | 368/204 |
| 2004/0201534 | A1 | 10/2004 | Hagiwara | |
| 2004/0263415 | A1 | 12/2004 | Pearlmana et al. | |

FOREIGN PATENT DOCUMENTS

| | | | |
|---|---|---|---|
| JP | 09298417 | | 11/1997 |
| JP | 09312514 | A2 | 12/1997 |
| JP | 11074720 | A2 | 3/1999 |
| JP | 2002043828 | | 2/2002 |
| JP | 2003152427 | | 5/2003 |
| JP | 2003273627 | | 9/2003 |
| WO | WO0124315 | A1 | 4/2001 |

OTHER PUBLICATIONS

Abstract of patent JP09312514A2, Dec. 2, 1997.
Abstsract of patent JP11074720A2, Mar. 16, 1999.
Abstract of patent JP2002043828, Feb. 3, 2002.
Abstract of patent JP2003273627, Sep. 26, 2003.
Abstract of patent WO0124315A1, Apr. 5, 2001.
Abstract of patent JP2003152427, May 23, 2003.

* cited by examiner

MICRO-HELIX ANTENNA AND METHODS FOR MAKING SAME

DESCRIPTION

This application claims the benefit of provisional application Ser. No. 60/576,378, filed Jun. 2, 2004 entitled Micro-Helix Antenna, the contents of which are hereby incorporated by reference.

FIELD OF THE INVENTION

The present invention relates generally to helical antennas and methods for making helical antennas.

BACKGROUND OF THE INVENTION

There is a growing need in many technical fields to form smaller antenna elements. One technique often employed in antenna design is to embed an inductor within the antenna to add electrical length to an otherwise size-reduced antenna, making the antenna behave as if it were longer. This technique is often employed in standard CB-type antennas to provide length reduction and impedance matching. Conventional helical antennas typically utilize helix diameters that are a significant fraction of a wavelength. However, such antennas generally are too large in diameter to allow further compression. Thus, there is a need for an antenna comprising a helically formed slow-wave conductor element that can be further compressed into a selected pattern, such as a stochastic or spiral motif.

SUMMARY OF THE INVENTION

In one embodiment, the antenna of the present invention comprises an elongate dielectric core, and at least a first helically-shaped conductor disposed about the core. The diameter of the helix formed by the conductor is less than about 1/100 of the wavelength of the antenna.

In another aspect, the antenna of this invention comprises an elongate dielectric core with at least a first helically-shaped conductive element disposed on the core, wherein the core with the helically-shaped conductor thereon is compressed.

Still further, the present invention is directed to a method for making an antenna. The method for making an antenna comprises providing a helically-shaped conductive element on a dielectric core so that the diameter of the helix formed by the conductor is less than about 1/100 of the wavelength of the antenna.

Further still, the present invention contemplates a method for making an antenna comprising providing a helically-shaped conductive element on a dielectric core and compressing the core with the helically-shaped conductor thereon.

DETAILED DESCRIPTION OF THE PREFERRED EMBODIMENTS

The present invention is directed to the fabrication of antennas that are significantly smaller than their established solid-conductor counterparts, such as the half-wave linear dipole. By using a "micro-helix" conductor element, significant size reductions may be achieved. Micro-helix conductors of the present invention may be used in straight-wire antennas (linear dipoles), stochastic or other meandering line antennas, spiral antennas, and other compression schemes.

Figure 1:
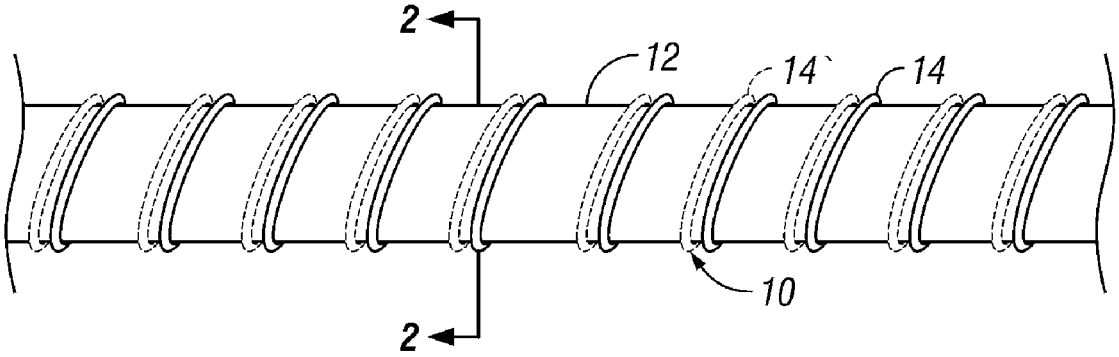
FIG. 1 is a fragmented, side elevational view of an antenna constructed in accordance with one embodiment of the present invention.

Turning now to the drawings in general and to FIG. 1 in particular, there is shown therein an antenna constructed in accordance with the present invention and designated generally by the reference numeral 10. The antenna 10 preferably comprises an elongate dielectric core 12 and at least a first helically-shaped conductor 14 disposed about the core.

The dielectric core 12 preferably is flexible but relatively nonelastic to allow further compression as described in more detail below. In the embodiment of FIG. 1, the core 12 is formed of fishing line made of nylon-based copolymers. The diameter of the core 12 is about 250 μm.

The conductor 14 preferably is a flexible but relatively nonelastic material. Preferably, the conductor is metal, such as copper or silver. For example, in the embodiment of FIG. 1, the conductor is a very fine copper wire, such as 50 AWG copper wire. This fine copper wire can be wrapped around the core 12, so that the conductor is formed into a helix with uniform pitch.

As indicated in broken lines in FIG. 1, a second helically-shaped conductor 14' may be included, thus providing a double helix. The direction of the second conductor 14' may be the same as or opposite of the first conductor 14. Although in the embodiment shown, the second conductor 14' is adjacent to the first conductor 14, this position may vary. For example, the second conductor 14' may be rotated 180 degrees from the first conductor 14.

The direction (handedness), pitch and diameter of the helix of the antenna may vary. However, in accordance with the present invention, the diameter of the helix is relatively small as compared to the wavelength of the antenna. Preferably, the diameter is less than about 1/100th of the wavelength. More preferably, the diameter is less than about 1/500th of the wavelength. Most preferably, the diameter is less than about 1/1000th of the wavelength.

Figure 2:
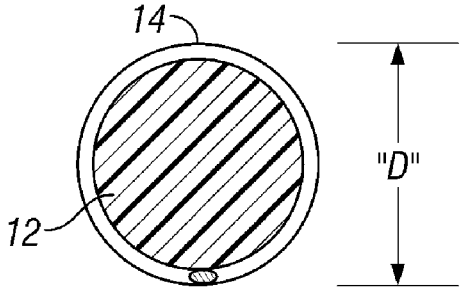
FIG. 2 is a cross-sectional view of the antenna taken along line 2—2 of FIG. 1.

In the embodiment of FIG. 1, the conductor 14 is wrapped about the core 12 at about 8 turns per mm forming a helix having a diameter "D," as shown in FIG. 2. The diameter of this helix is about the same as the core, that is, about 250 μm. The length of the core, and therefore the length of the assembled antenna may vary. In the embodiment of FIG. 1, which is fragmented and not drawn to scale, the core 12 is about 1½ inch long. This provides a 1300 MHz antenna about 67% shorter than a comparable standard half-wave dipole antenna.

Figure 3C:
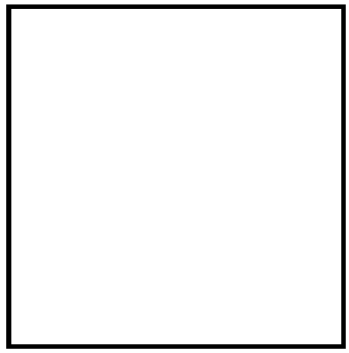
FIGS. 3A–3C are diagrammatic illustrations of three possible cross-sectional shapes of the micro-helix conductor.
Figure 3B:
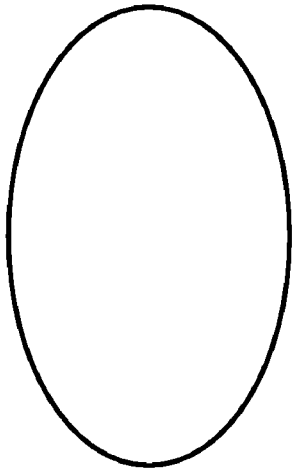
Figure 3A:
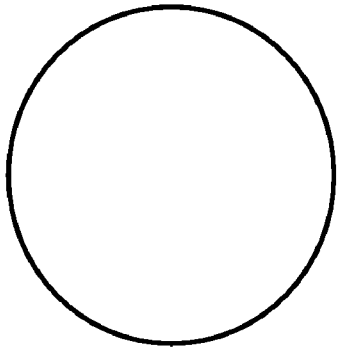

As shown in FIG. 2, because the core 12 is circular in cross section, the cross-sectional shape of the helix formed by the conductor 14 is also circular, as illustrated diagrammatically in FIG. 3A. It will be understood that the cross-sectional shape of the helix may vary widely. For example, other suitable shapes include ovoid, seen in FIG. 3B, and polygonal (having multiple straight sides), such as a square, seen in FIG. 3B. Preferably, when the cross-sectional shape is polygonal, all sides of the polygon will be of equal length. Thus, as used herein, "helix" is not limited to a helix with a circular cross-sectional shape.

Figure 4:
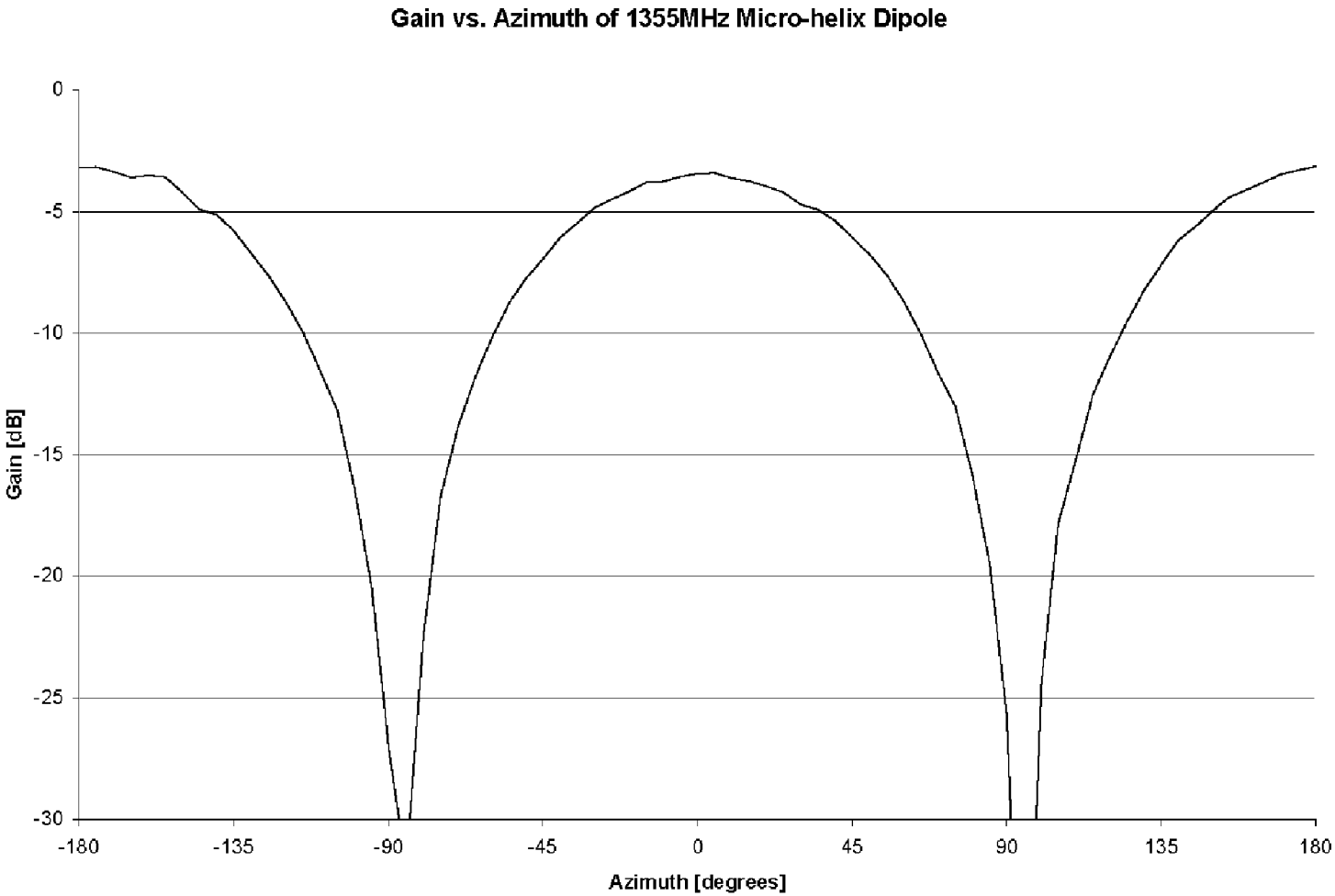
FIG. 4 is a graph illustrating the performance of a linear dipole antenna constructed in accordance with the present invention.

FIG. 4 contains a graph illustrating test data of a 1300 MHz linear dipole antenna made by wrapping 50AWG copper wire around a 250 μm wide fishing line about 1.5 inches long. The wire was wrapped at about 8 turns per millimeter.

Figure 5:
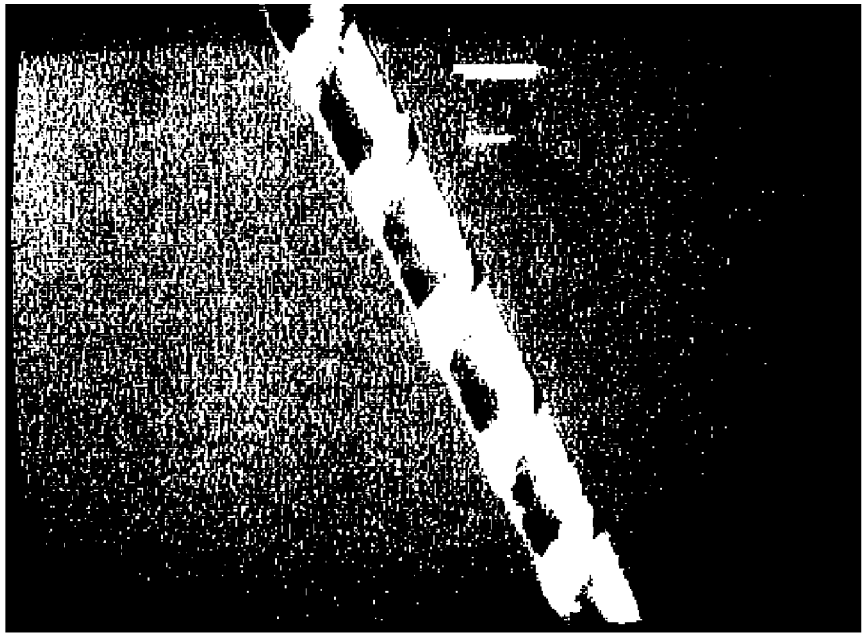
FIG. 5 is a photograph showing a portion of a micro-helix antenna formed by a direct-write process applying silver to the surface of glass fiber.

Although the above described method of wrapping a fine wire around a fishing line or other elongate core is suitable in many applications, other methods for forming the helical conductor may be used. For example, a strip or bead of silver may be applied to a core, such as a glass fiber, in a helical pattern by using a direct-write process. An enlarged view of a portion of an antenna formed by this method is shown in the photograph of FIG. 5. In this example, the helix formed had about 3 turns per millimeter, and the glass fiber was about 125 μm in diameter.

Figure 6:
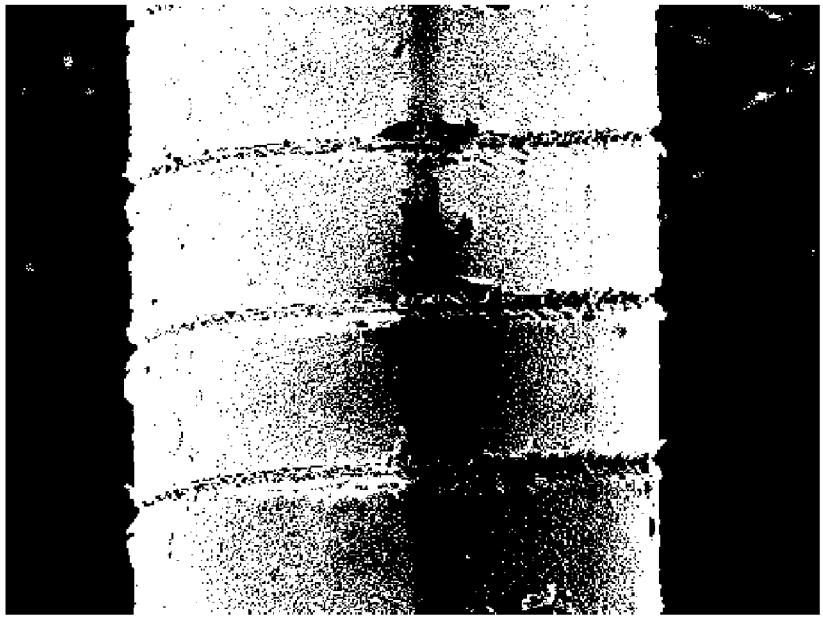
FIG. 6 is a photograph showing a portion of a micro-helix antenna formed by laser ablation of the silver coating on a glass core.

In yet another embodiment of the present invention, the antenna 10 is formed from a silver-coated glass fiber core. A laser is used to ablate a helical pattern on the core, leaving a helically shaped strip of silver. As used herein, "ablate" means to remove by etching, erosion, melting, evaporation, vaporization or other suitable techniques. An enlarged view of a portion of an antenna formed by this method is shown in the photograph of FIG. 6.

Figure 7:
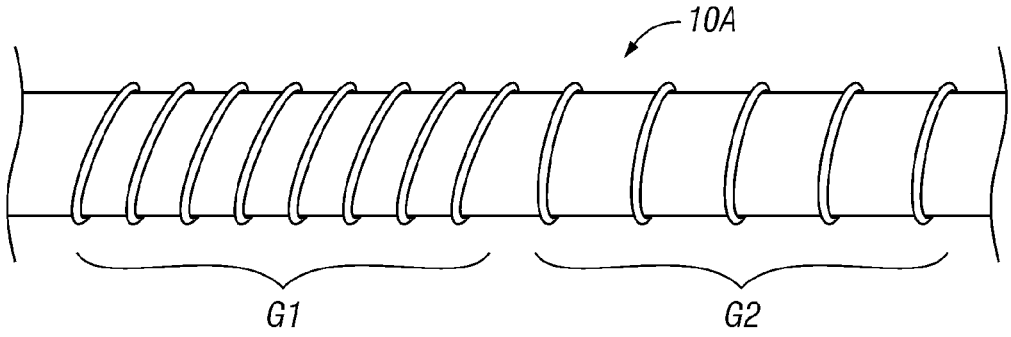
FIG. 7 is a fragmented side elevation view of a micro-helix antenna according to another embodiment in which the pitch of the helix is non-uniform.

The pitch of the of the turns in the micro-helix antenna 10 may be uniform, that is, the pitch of all the turns may be the same, as shown in FIG. 1. However, as shown in the antenna 10A of FIG. 7, the pitch may vary along the length of the antenna, that is, the pitch may be non-uniform In such a case, the varying pitch measurements are selected to modify the performance characteristics of the antenna. For example, the turns can be arranged in groups having different pitches. As shown in FIG. 7, the first group $G_1$ has 8 turns per millimeter and the second group $G_2$ has five turns per millimeter.

The very small relative diameter of the antennas of this invention permits the assembled antennas to be compressed, that is, the antennas assume the mechanical and formative properties of the core on which they are formed. Where the core is flexible, the antenna can be manipulated as if it were simply a solid wire. Accordingly, various antenna compression techniques can be applied to this micro-helical antenna.

Figure 8:
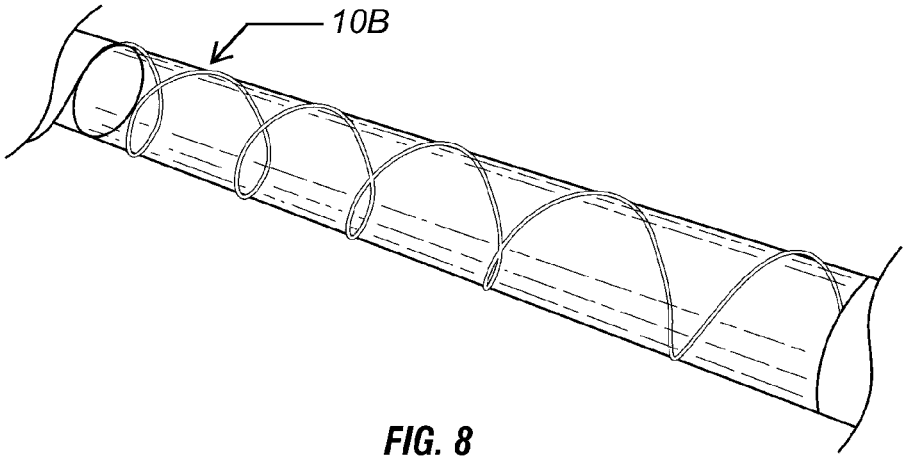
FIG. 8 is a fragmented perspective view of a micro-helix antenna further compressed into a three-dimensional helical shape. The micro-helical shape of the conductor element is not shown.
Figure 9:
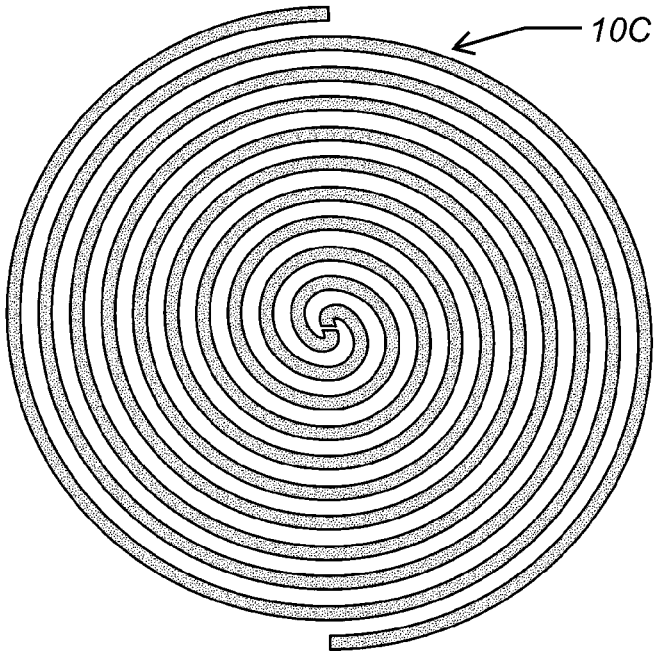
FIG. 9 illustrates a pair of micro-helix antennas compressed into a two-dimensional double spiral shape. The micro-helical shape of the conductor element is not shown.
Figure 10:
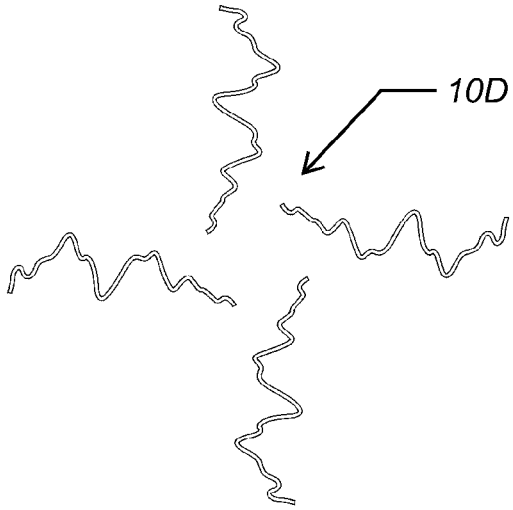
FIG. 10 illustrates four micro-helix antennas formed into a two-dimensional stochastic shape. The micro-helical shape of the conductor element is not shown.

The antenna of the present invention can be formed into three-dimensional shapes, such as the helical antenna 10B shown in FIG. 8. Alternately, the antenna can take the form of a two-dimensional double spiral 10C, as seen in FIG. 9, or the stochastically shaped planar antenna illustrated in FIG. 10. The shapes illustrated herein are exemplary only. It will be understood that the mico-helix antenna may be shaped in virtually any two- and three-dimensional configuration as any other straight line antenna may be, including discone and double-helix.

Now it will be appreciated that the present invention provides a slow-wave micro-helix antenna in which a very small diameter helix is used to incorporate and distribute an inductance along the entire length of the antenna as opposed to a few lumped-element inductances. This allows for the design of antennas with very significant size reductions while at the same time maintaining good radiation performance and VSWR (voltage standing wave ratio). The wire-like behavior of the micro helix antenna of this invention allows the helical assembly to be treated as if it were a simple wire conductor, which can be fashioned into other size-reducing antenna shapes, such as stochastic, helical and spiral antennas.

Changes can be made in the combination and arrangement of the various parts and elements described herein without departing from the spirit and scope of the invention as defined in the following claims.

What is claimed is:

1. An antenna comprising:

an elongate dielectric core;

at least a first helically-shaped conductor disposed about the core;

wherein the diameter of the helix formed by the conductor is less than about 1/100 of the wavelength of the antenna.

2. The antenna of claim 1 wherein the diameter of the helix is less than about 1/500 of the wavelength of the antenna.

3. The antenna of claim 1 wherein the diameter of the helix is less than about 1/1000 of the wavelength of the antenna.

4. The antenna of claim 1 wherein the core is flexible.

5. The antenna of claim 1 wherein the cross-sectional shape of the helix formed by the conductor is circular.

6. The antenna of claim 1 wherein the cross-sectional shape of the helix formed by the conductor is ovoid.

7. The antenna of claim 1 wherein the cross-sectional shape of the helix formed by the conductor is polygonal.

8. The antenna of claim 7 wherein all the sides of the polygonally-shaped helix are of equal length.

9. The antenna of claim 1 wherein the core with the helically-shaped conductor thereon is compressed.

10. The antenna of claim 9 wherein the core with the helically-shaped conductor thereon is compressed stochastically.

11. The antenna of claim 9 wherein the core with the helically-shaped conductor thereon is compressed spirally.

12. The antenna of claim 1 wherein the core with the helically-shaped conductor thereon is straight.

13. The antenna of claim 1 wherein the core with the helically-shaped conductor thereon is two-dimensional.

14. The antenna of claim 1 wherein the core with the helically-shaped conductor thereon is three-dimensional.

15. The antenna of claim 1 further comprising a second helically-shaped conductor disposed on the core.

16. The antenna of claim 1 wherein the helically-shaped conductor is a metal wire wrapped around the core.

17. The antenna of claim 1 wherein the helically-shaped conductor is a metal coating on the core.

18. The antenna of claim 1 wherein the pitch of the helix formed by the conductor is non-uniform.

19. An antenna comprising:

an elongate dielectric core; and at least a first helically-shaped conductive element disposed on the core;

wherein the core with the helically-shaped conductor thereon is compressed.

20. The antenna of claim 19 wherein the core with the helically-shaped conductor thereon is compressed stochastically.

21. The antenna of claim 19 wherein the cross-sectional shape of the helix formed by the conductor is circular.

22. The antenna of claim 19 wherein the cross-sectional shape of the helix formed by the conductor is ovoid.

23. The antenna of claim 19 wherein the cross-sectional shape of the helix formed by the conductor is polygonal.

24. The antenna of claim 23 wherein all the sides of the polygonally-shaped helix are of equal length.

25. The antenna of claim 19 wherein the core is flexible.

26. The antenna of claim 19 further comprising a second helically-shaped conductor disposed on the core.

27. The antenna of claim 19 wherein the core with the helically-shaped conductor thereon is two-dimensional.

28. The antenna of claim 19 wherein the core with the helically-shaped conductor thereon is three-dimensional.

29. The antenna of claim 19 wherein the helically-shaped conductor is a metal wire wrapped around the core.

30. The antenna of claim 19 wherein the helically-shaped conductor is a metal coating on the core.

31. The antenna of claim 19 wherein the core with the helically-shaped conductor thereon is compressed spirally.

32. The antenna of claim 19 wherein the pitch of the helix formed by the conductor is non-uniform.

33. A method for making an antenna comprising:

providing a helically-shaped conductive element on a dielectric core so that the diameter of the helix formed by the conductor is less than about 1/100 of the wavelength of the antenna.

34. The method of claim 33 wherein the helically-shaped conductive element is provided by wrapping a wire around the core.

35. The method of claim 33 wherein the helically-shaped conductive element is provided by ablating a helically-shaped strip from a conductive metal coating on the core.

36. The method of claim 35 wherein the ablation of the helically-shaped strip is carried out using a laser.

37. The method of claim 35 wherein the metal is silver.

38. The method of claim 33 wherein the helically-shaped conductive element is provided by applying a helically-shaped strip of conductive metal to the core.

39. The method of claim 38 wherein the application of the helically-shaped strip of conductive metal is carried out using a direct-write process.

40. The method of claim 38 wherein the metal is silver.

41. The method of claim 33 further comprising compressing the core with the helically-shaped conductor thereon.

42. The method of claim 41 wherein the core with the helically-shaped conductor thereon is compressed spirally.

43. The method of claim 41 wherein the core with the helically-shaped conductor thereon is compressed stochastically.

44. The method of claim 33 wherein the pitch of the helix formed on the conductor is non-uniform.

45. A method for making an antenna comprising:

providing a helically-shaped conductive element on a dielectric core; and compressing the core with the helically-shaped conductor thereon.

46. The method of claim 45 wherein the helically-shaped conductive element is provided by wrapping a wire around the core.

47. The method of claim 45 wherein the helically-shaped conductive element is provided by ablating a helically-shaped strip from a conductive metal coating on the core.

48. The method of claim 47 wherein the ablation of the helically-shaped strip is carried out using a laser.

49. The method of claim 47 wherein the metal is silver.

50. The method of claim 45 wherein the helically-shaped conductive element is provided by applying a helically-shaped strip of conductive metal to the core.

51. The method of claim 50 wherein the application of the helically-shaped strip of conductive metal is carried out using a direct-write process.

52. The method of claim 50 wherein the metal is silver.

53. The method of claim 45 wherein the core with the helically-shaped conductor thereon is compressed spirally.

54. The method of claim 45 wherein the core with the helically-shaped conductor thereon is compressed stochastically.

55. The method of claim 45 wherein the pitch of the helix provided on the core is non-uniform.

* * * * *